US006957969B2

(12) United States Patent
Kodera et al.

(10) Patent No.: US 6,957,969 B2
(45) Date of Patent: Oct. 25, 2005

(54) CARD CONNECTOR ALLOWING EASY REMOVAL OF A CARD AFTER THE CARD IS EJECTED

(75) Inventors: Masafumi Kodera, Tokyo (JP); Keisuke Nakamura, Tokyo (JP); Koichiro Tsuji, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/918,837

(22) Filed: Aug. 13, 2004

(65) Prior Publication Data

US 2005/0037648 A1 Feb. 17, 2005

(30) Foreign Application Priority Data

Aug. 14, 2003 (JP) ..... 2003-293556

(51) Int. Cl.[7] ..... H01R 13/62
(52) U.S. Cl. ..... 439/152; 439/159
(58) Field of Search ..... 439/152, 159–160, 439/157, 630, 155, 372; 235/441, 492; 361/736–737, 361/756, 740–741

(56) References Cited

U.S. PATENT DOCUMENTS

| | | | | |
|---|---|---|---|---|
| 6,717,817 | B2 * | 4/2004 | Liu et al. | 361/737 |
| 6,776,632 | B2 * | 8/2004 | Kikuchi et al. | 439/159 |
| 2002/0137378 | A1 * | 9/2002 | Kuroda | 439/159 |
| 2003/0068927 | A1 * | 4/2003 | Nakamura | 439/630 |
| 2003/0119350 | A1 * | 6/2003 | Chen | 439/159 |

FOREIGN PATENT DOCUMENTS

| | | |
|---|---|---|
| JP | H06 3794 | 5/1994 |
| JP | 2800801 | 7/1998 |

* cited by examiner

*Primary Examiner*—J. F. Duverne
(74) *Attorney, Agent, or Firm*—Collard & Roe, P.C.

(57) ABSTRACT

In a card connector including a card guide for guiding movement of a card in a first direction, the card guide defines a fitting position and a releasing position of the card in the first direction. A slider is coupled to the card guide to be slidable in the first direction. The slider is continuously urged by an elastic member towards the fitting position. When the slider is slid against urging force of the elastic member, a butting portion of the slider is engaged with the card at the fitting position to transfer the card to the releasing position.

10 Claims, 14 Drawing Sheets

CARD CONNECTOR ALLOWING EASY REMOVAL OF A CARD AFTER THE CARD IS EJECTED

This application claims priority to prior Japanese application JP 2003-293556, the disclosure of which is incorporated herein by reference.

BACKGROUND OF THE INVENTION

This invention relates to a card connector having an ejecting mechanism for ejecting a card by moving a slider.

A connector of the type is disclosed in, for example, Japanese Patent (JP-B) No. 2800801 and comprises a guide portion for guiding a card, and an eject frame as a slider slidable along the guide portion. The eject frame has an engaging portion to be engaged with the card. By a sliding operation of the eject frame, the card is moved along the guide portion to be ejected from the connector.

Another connector of the type is disclosed in Japanese Utility Model Application Publication (JP-U) No. H6-37914 and comprises a guide portion for guiding a card, and a tray portion as a slider slidable along the guide portion. The tray portion has an engaging portion to be engaged with the card. By a sliding operation of the tray portion, the card is moved along the guide portion to be ejected from the connector.

In each of the above-mentioned connectors, the card ejected from the connector overlaps the slider. In this state, the card is difficult to be clamped by fingers. Thus, a user suffers inconvenience when the card is removed from the connector.

SUMMARY OF THE INVENTION

It is therefore an object of the present invention to provide a card connector which allows easy removal of a card after the card is ejected from the card connector.

Other objects of the present invention will become clear as the description proceeds.

According to an aspect of the present invention, there is provided a card connector for use in connecting a card, the card connector comprising a card guide for defining a fitting position and a releasing position of the card in a first direction and for guiding movement of the card, a slider coupled to the card guide to be slidable in the first direction, and an elastic member continuously urging the slider towards the fitting position, the slider having a butting portion to be engaged with the card at the fitting position to transfer the card to the releasing position when the slider is slid against urging force of the elastic member.

DESCRIPTION OF THE PREFERRED EMBODIMENTS

Figure 1:
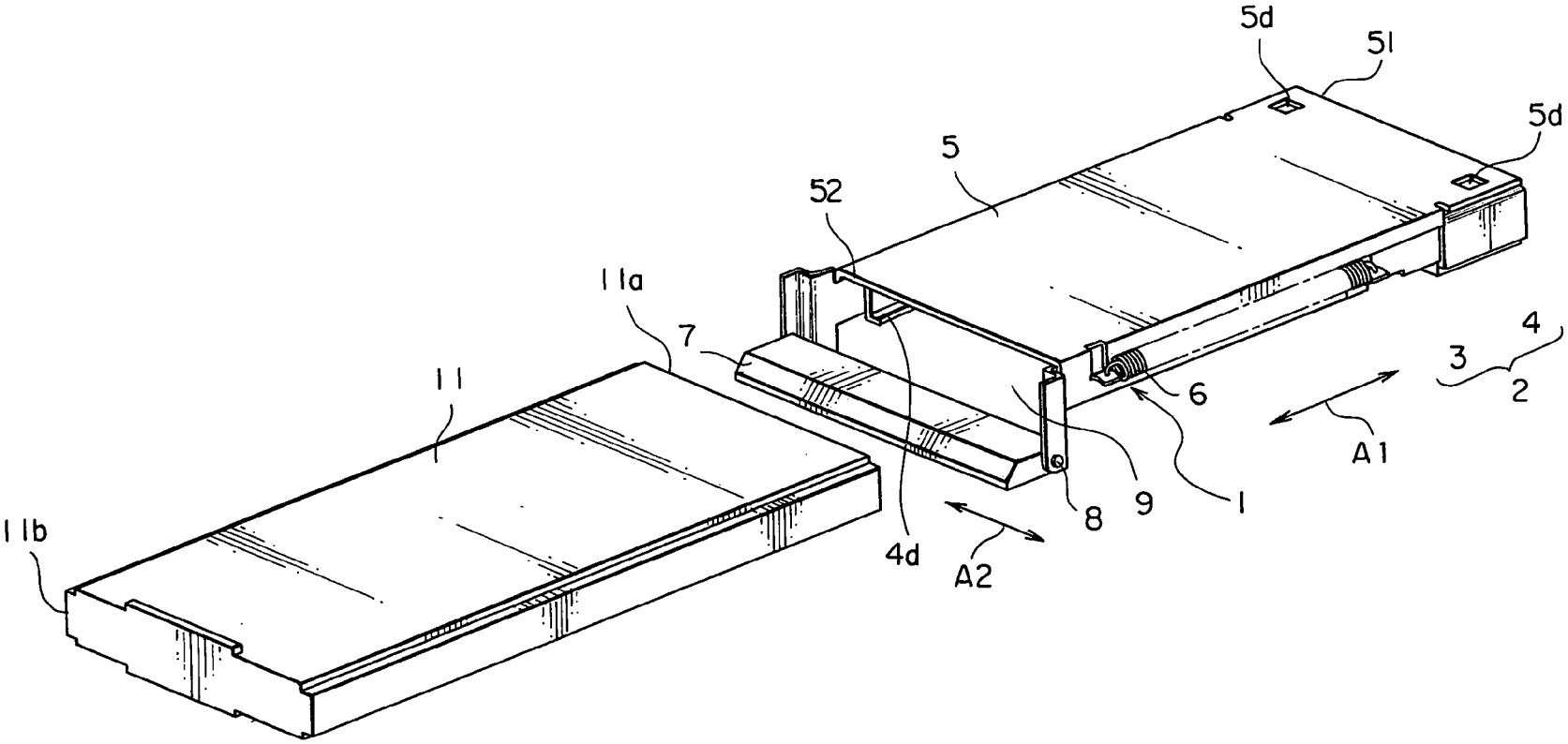
FIG. 1 is a perspective view of a card connector according to a first embodiment of the present invention together with a card.

Now, description will be made of several embodiments of the present invention with reference to the drawing.

Figure 2:
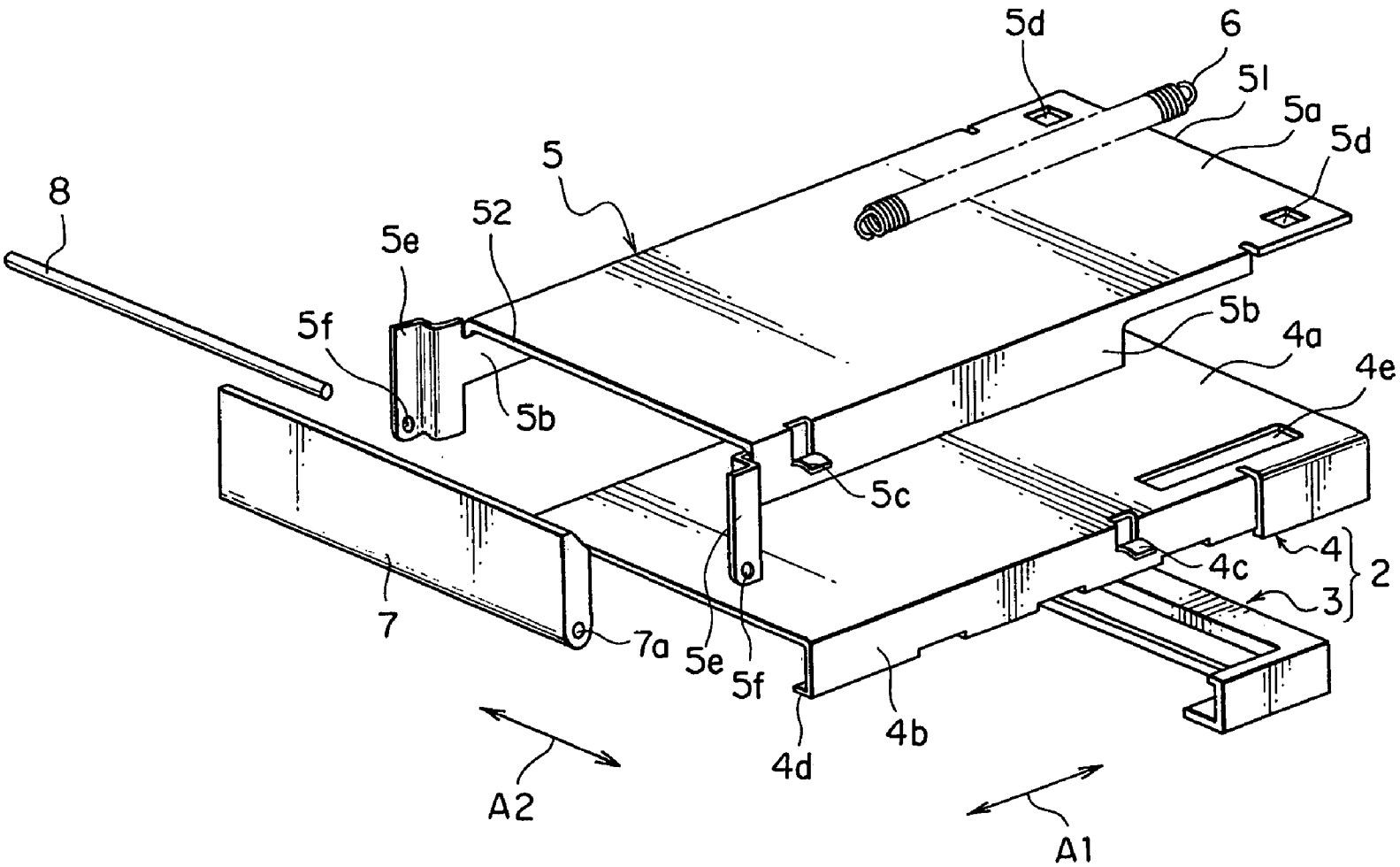
FIG. 2 is an exploded perspective view of the card connector illustrated in FIG. 1.

Referring to FIGS. 1 and 2, a card connector according to a first embodiment of the present invention will be described.

The card connector 1 illustrated in the figure serves to connect a card 11 and comprises an ejecting mechanism which will later become clear.

The card connector 1 includes a connector body 2 comprising an insulator 3 and a card guide 4 with the insulator 3 fixed to its one end. The insulator 3 is provided with a plurality of conductive contact points (not shown) to be electrically connected to the card 11.

The card guide 4 is a channel-like member and has a horizontal main plate portion 4*a* of a rectangular shape extending long in a first direction A1, and a pair of side plate portions 4*b* (only one being illustrated in the figures) bent downward from two long sides of the main plate portion 4*a*, respectively, and faced to each other. Each of the side plate portions 4*b* has a protruding portion 4*c* formed by cutting and raising outward at an intermediate position in the first direction A1, and a guide portion 4*d* bent inward from a lower end of the side plate portion 4*b*. The guide portion 4*d* is formed intermittently in the first direction A1. The main plate portion 4*a* has a pair of windows 4*e* formed in the vicinity of the side plate portions 4*b*, respectively, and extending in the first direction A1.

To the card guide 4, a slider 5 is coupled to be slidable in the first direction A1. The slider 5 is a channel-like member and has a horizontal main plate portion 5*a* of a rectangular shape extending long in the first direction A1, and a pair of side plate portions 5*b* bent downward from two long sides of the main plate portion 5*a,* respectively, and faced to each other. The slider 5 is fitted over the outside of the card guide 4 from an upper side thereof. As a result, the main plate portion 5*a* of the slider 5 is faced to the main plate portion 4*a* of the card guide 4 and the side plate portions 5*b* of the slider 5 are faced to the side plate portions 4*b* of the card guide 4, respectively.

Each of the side plate portions 5*b* of the slider 5 is provided with a protruding portion 5*c* formed by cutting and raising outward at an intermediate position in the first direction A1 to protrude outward. The main plate portion 5*a* is provided with a pair of engaging pieces or butting portions 5*d* formed by cutting and raising in the vicinity of a first end 51 thereof in the first direction A1 and protruding through the windows 4*e* of the card guide 4 to the inside of the card guide 4. The slider 5 is provided with a pair of tab supporting portions 5*e* formed on opposite sides of a second end 52 of the slider 5 in the first direction A1. Each of the tab supporting portions 5*e* is provided with a shaft insertion hole 5*f.*

To the tab supporting portions 5*e,* a tab 7 in the form of a rectangular plate is attached. Specifically, a shaft 8 is inserted through a pair of through holes 7*a* formed on the tab 7 in a second direction A2 perpendicular to the first direction A1. Opposite ends of the shaft 8 are inserted into the shaft insertion holes 5*f,* respectively. Thus, the tab 7 is rotatable around the shaft 8 to close and open a card insertion slot 9 of the connector 1. The card insertion slot 9 is generally defined by the main plate portion 4*a* and the guide portion 4*d* of the card guide 4.

The card connector 1 further comprises an elastic member, namely, a coil spring 6 acting as a tension spring known in the art. The coil spring 6 has opposite ends engaged with the protruding portion 4*c* of the card guide 4 and the protruding portion 5*c* of the slider 5, respectively.

Figure 3:
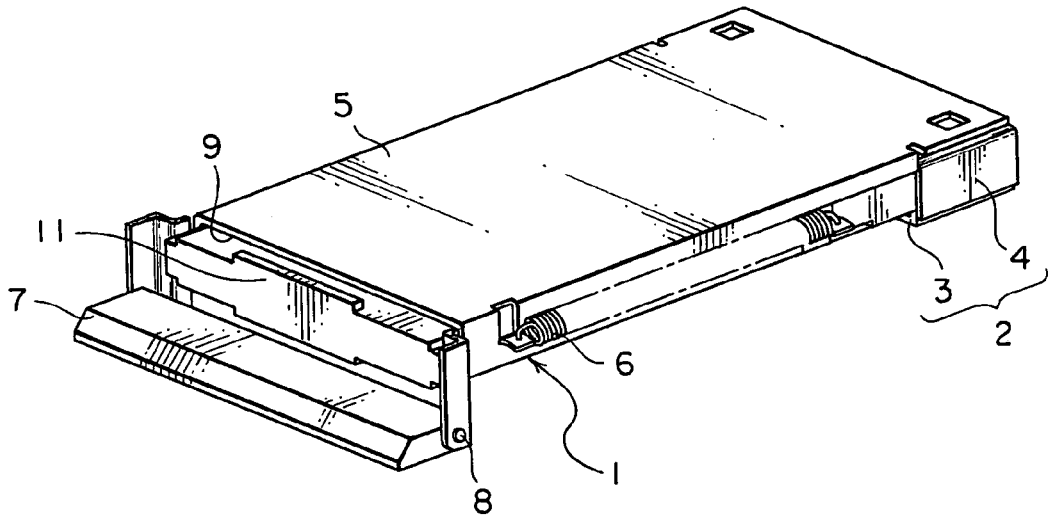
FIG. 3 is a perspective view of the card connector illustrated in FIG. 1 with the card inserted therein.
Figure 4:
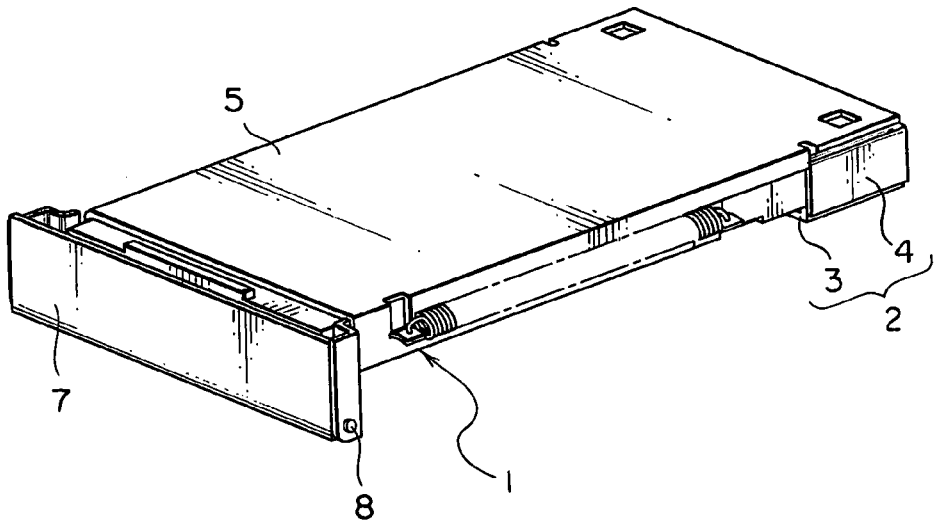
FIG. 4 is a perspective view of the card connector illustrated in FIG. 1 upon completion of connection of the card.

Referring to FIGS. 1, 3, and 4, description will be made of a process of inserting the card 11 into the card connector 1.

At first referring to FIG. 1, the card 11 is located in front of the card insertion slot 9 of the card connector 1. Next, the card 11 is clamped by fingers and inserted into the card insertion slot 9. Furthermore, the card 11 is pushed backward in the first direction A1. Thus, the card 11 is received in the card connector 1 as illustrated in FIG. 3. In this state, the card 11 is inserted between the main plate portion 4*a* and the guide portion 4*d* of the card guide 4. Subsequently, the tab 7 is rotated rightward by about 90° to close the card insertion slot 9 as illustrated in FIG. 4. In this state, the card 11 is located at a fitting position and connected to the card connector 1. The coil springs 6 are most relaxed.

Referring to FIGS. 5A through 8, description will be made of a process of ejecting the card 11 from the card connector 1.

Figure 5A:
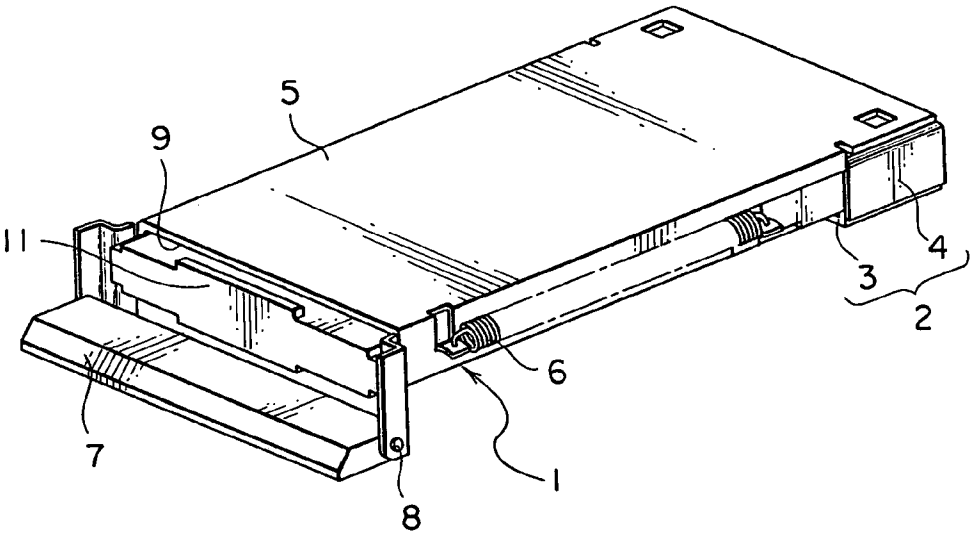
FIG. 5A is a perspective view for describing a first step of removing the card from the card connector illustrated in FIG. 1.
Figure 5B:
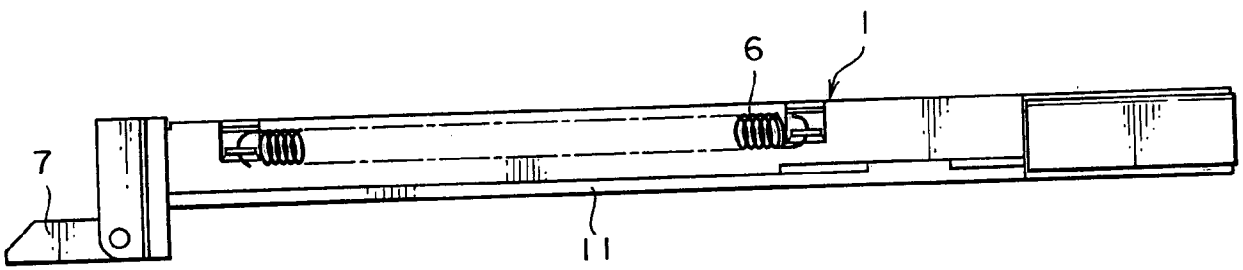
FIG. 5B is a side view corresponding to FIG. 5A.
Figure 6A:
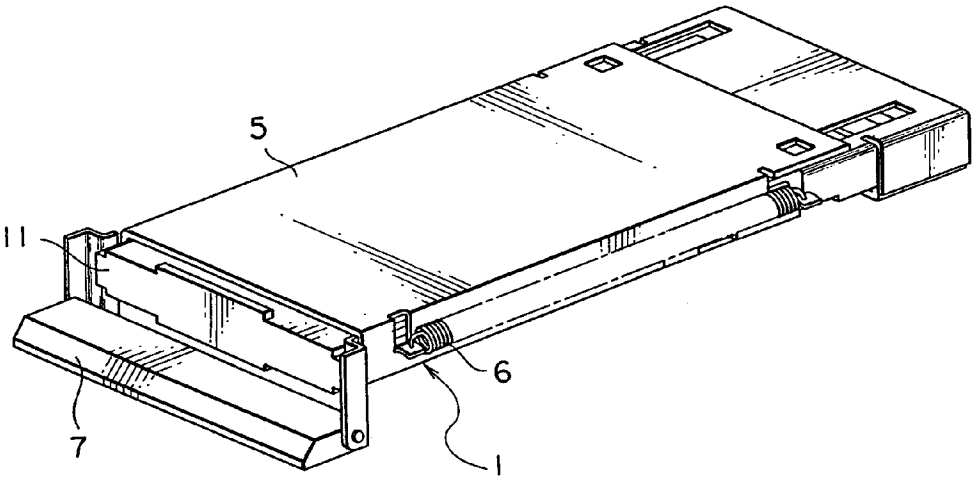
FIG. 6A is a perspective view for describing a second step of removing the card from the card connector illustrated in FIG. 1.
Figure 6B:
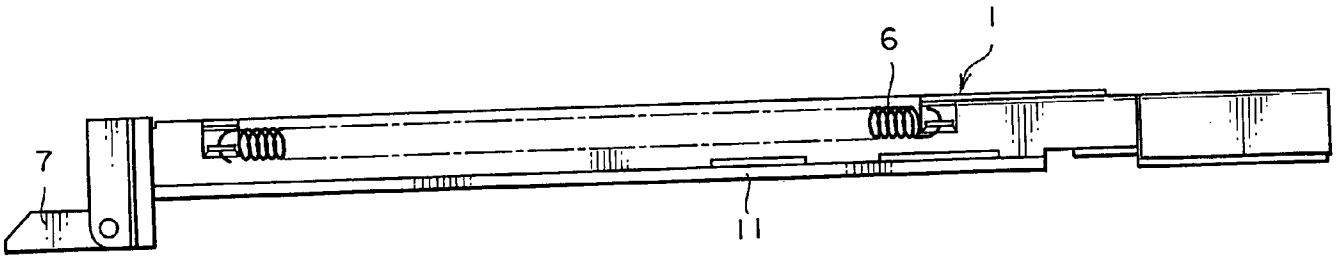
FIG. 6B is a side view corresponding to FIG. 6A.

At first referring to FIGS. 5A and 5B, the tab 7 is rotated leftward by about 90° to open the card insertion slot 9. Next, the tab 7 is clamped by fingers and pulled. Then, the slider 5 slides forward in the first direction A1 (leftward in the figure) and the butting portions 5*d* are engaged with a first end face (11*a* in FIG. 1) of the card 11. When the tab 7 is further pulled, the slider 5 slides forward together with the card 11 as illustrated in FIGS. 6A and 6B. As a result, the card 11 is separated from the conductive contact points mentioned above. Thus, the card 11 is ejected and moved to a releasing position. At this time, the coil springs 6 are tightened or strained. Thereafter, when the tab 7 is released from the fingers, the slider 5 is pulled by the coil springs 6 to return an initial position illustrated in FIGS. 7A and 7B. In order to prevent the card 11 from moving together with the slider 5 while the slider 5 returns to the initial position, the card guide 4 is preferably provided with a temporality holding portion such as a spring portion (not shown) for temporarily holding the card 11 as will later be described in conjunction with FIG. 9.

Figure 7A:
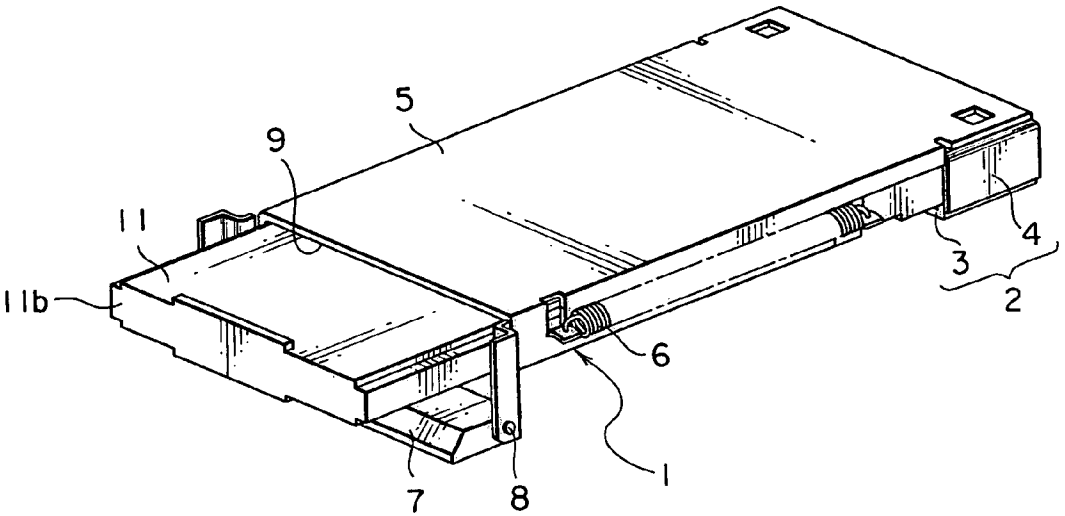
FIG. 7A is a perspective view for describing a third step of removing the card from the card connector illustrated in FIG. 1.
Figure 7B:
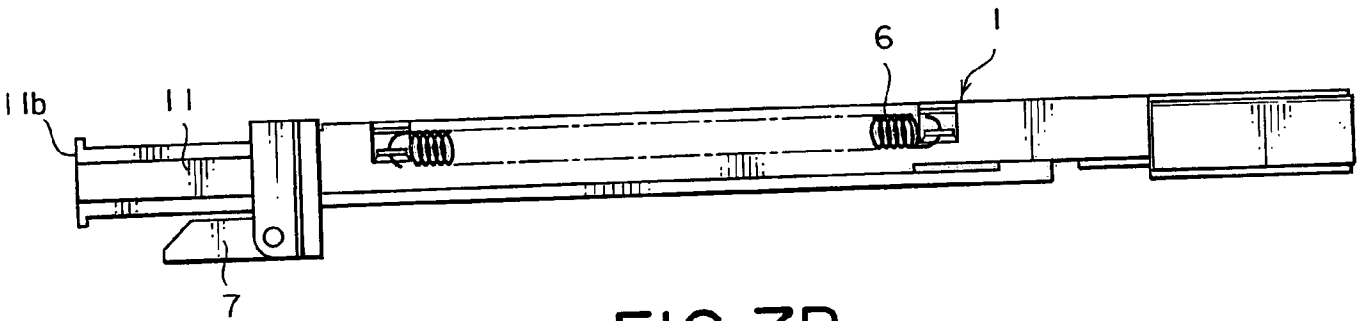
FIG. 7B is a side view corresponding to FIG. 7A.
Figure 8:
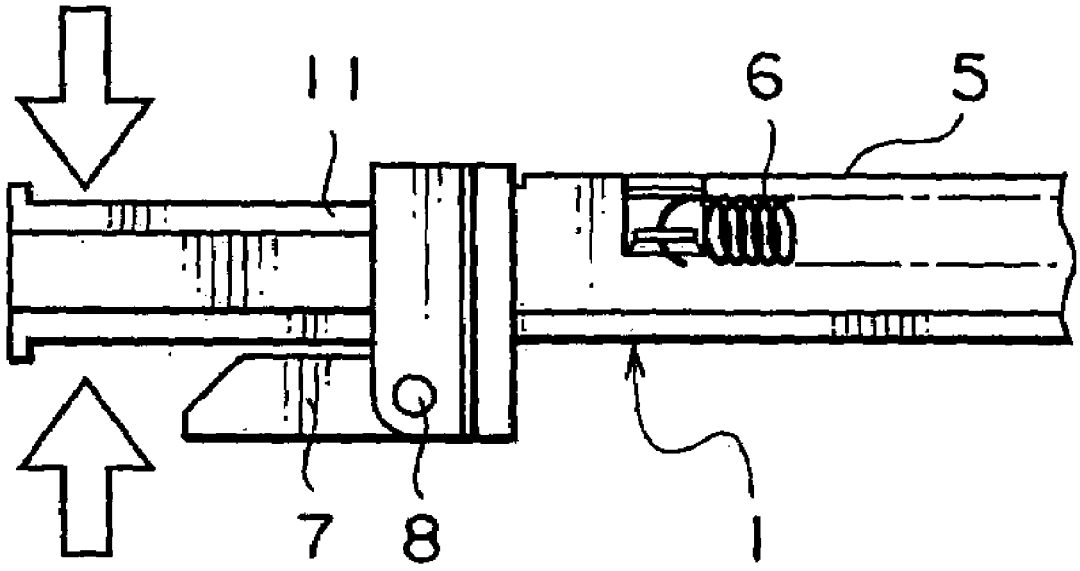
FIG. 8 is a partial side view for describing a fourth step of removing the card from the card connector illustrated in FIG. 1.

In the state illustrated in FIGS. 7A and 7B, an end portion adjacent to a second end face 11*b* of the card 11 is exposed. Therefore, it is easy to clamp the card 11 by the fingers as depicted by white arrows in FIG. 8 and to pull out the card 11 from the card connector 1. After the card 11 is pulled out, the tab 7 is rotated rightward by about 90° to close the card insertion slot 9.

Figure 9:
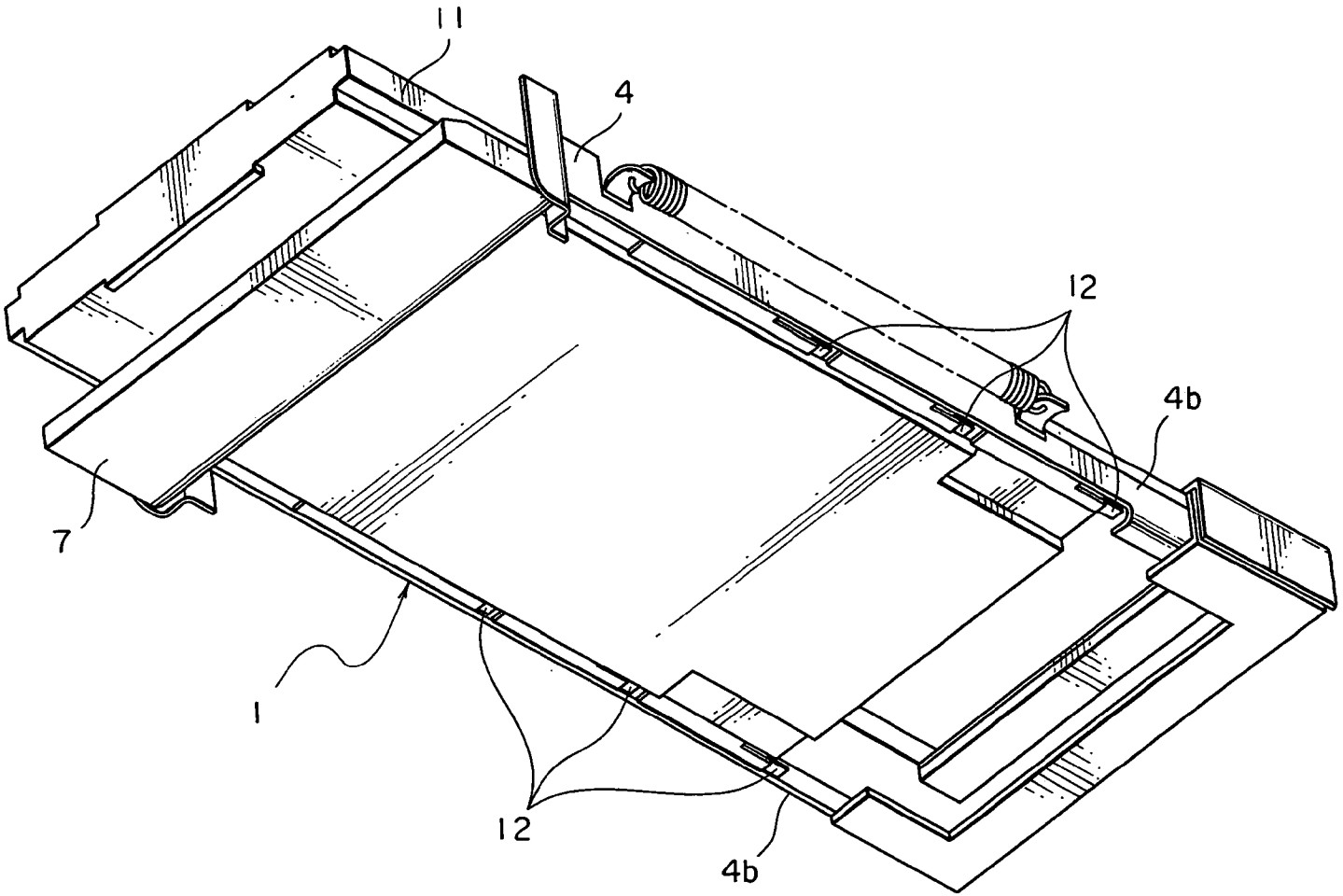
FIG. 9 is a perspective view of a card connector according to a second embodiment of the present invention as seen from a lower side.

Referring to FIG. 9, a card connector according to a second embodiment of the present invention will be described. Similar parts are designated by like reference numerals and will not be described.

In the card connector 1 illustrated in FIG. 9, the tab 7 is attached to the card guide 4. A lower part of each of the side plate portions 4*b* of the card guide 4 is bent inward to receive a plurality of temporary holding springs 12 formed at three positions. The temporary holding springs 12 press opposite sides of a lower surface of the card 11 towards the slider 5 (which is not shown in FIG. 9 because the slider 5 is positioned above the card guide 4). Therefore, the card 11 is stably held in an ejected state without a play.

Figure 10:
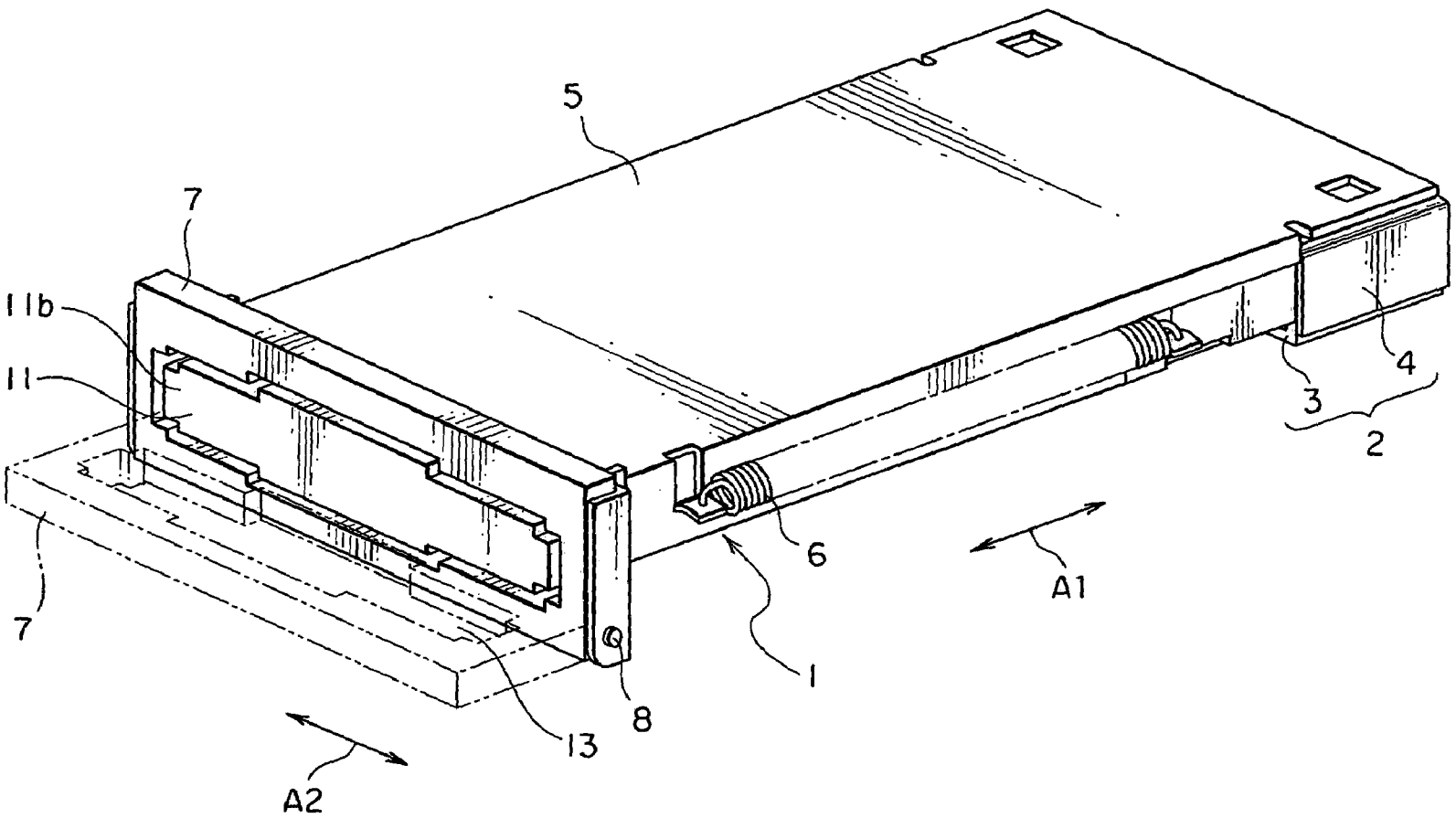
FIG. 10 is a perspective view of a card connector according to a third embodiment of the present invention.

Referring to FIG. 10, a card connector according to a third embodiment of the present invention will be described. Similar parts are designated by like reference numerals and will not be described.

In the card connector 1 illustrated in FIG. 10, the tab 7 is formed as a rectangular frame. In other words, the tab 7 has a window 13 formed at its center. With this structure, the second end face 11*b* of the card 11 is seen through the window 13.

Figure 11:
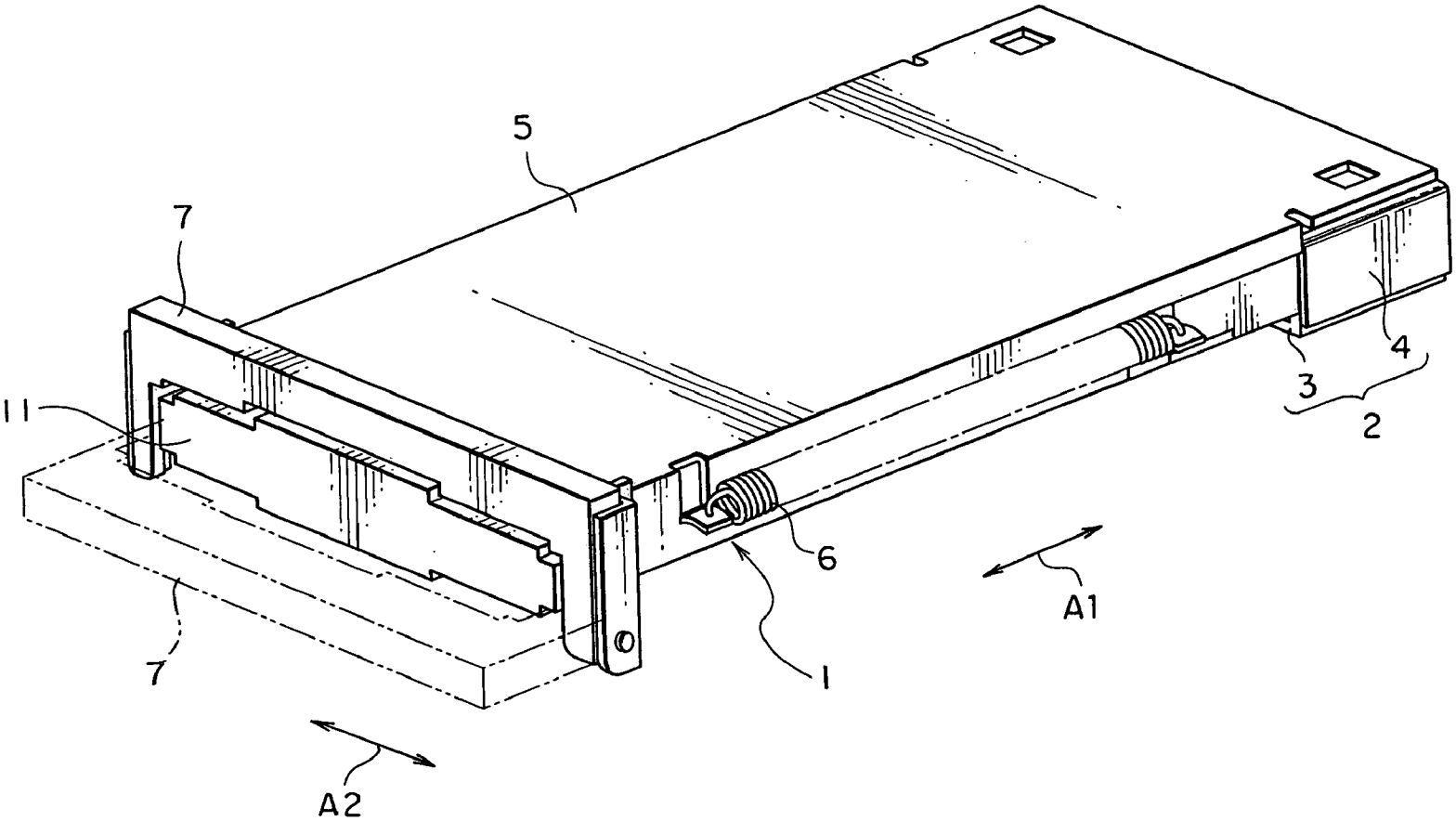
FIG. 11 is a perspective view of a card connector according to a fourth embodiment of the present invention.

Referring to FIG. 11, a card connector according to a fourth embodiment of the present invention will be described. Similar parts are designated by like reference numerals and will not be described.

In the card connector 1 illustrated in FIG. 11, the tab 7 is formed into an extended U shape.

Figure 12:
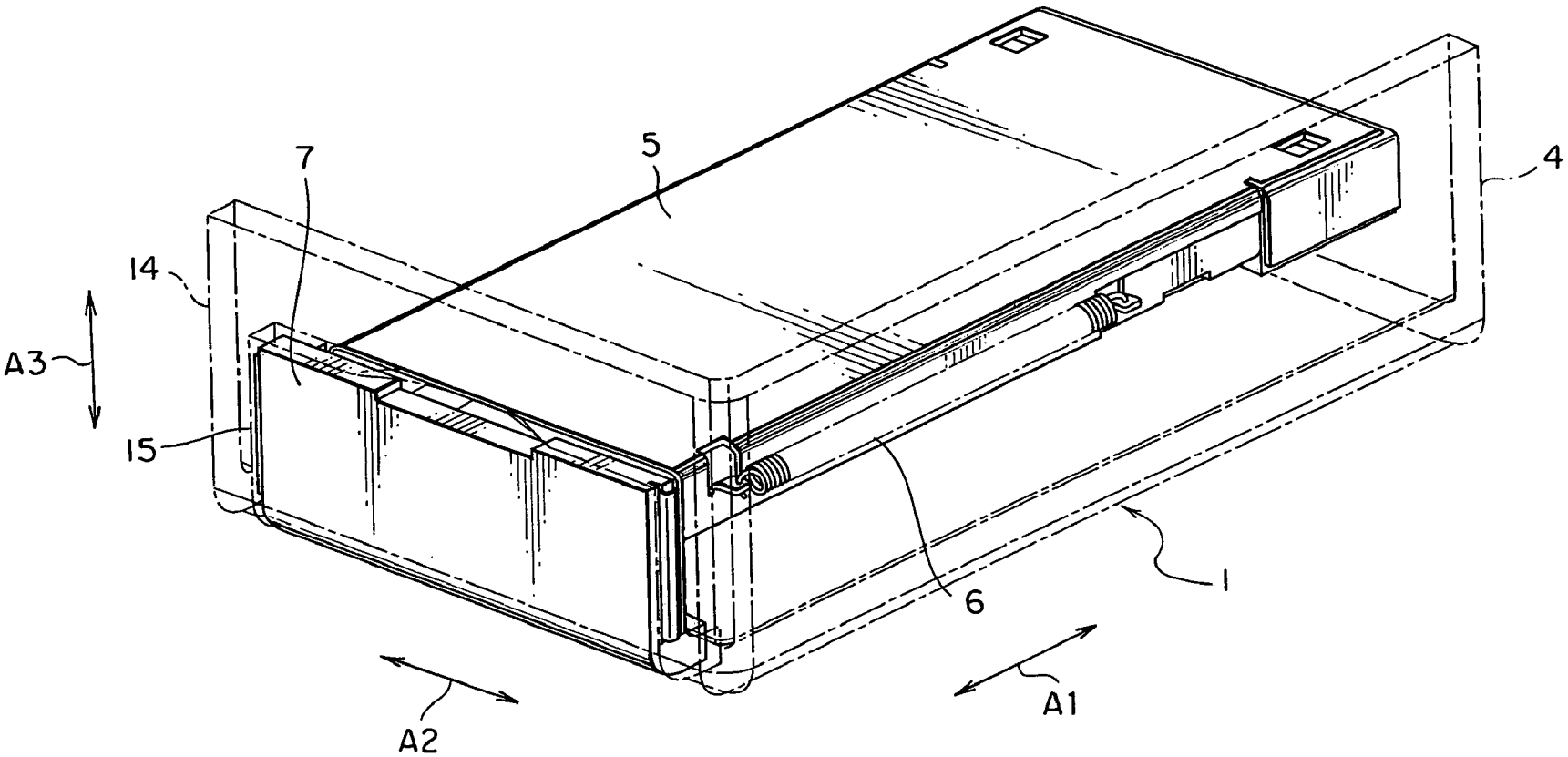
FIG. 12 is a perspective view of a card connector according to a fifth embodiment of the present invention when a card insertion slot is closed by a tab of the card connector.
Figure 13:
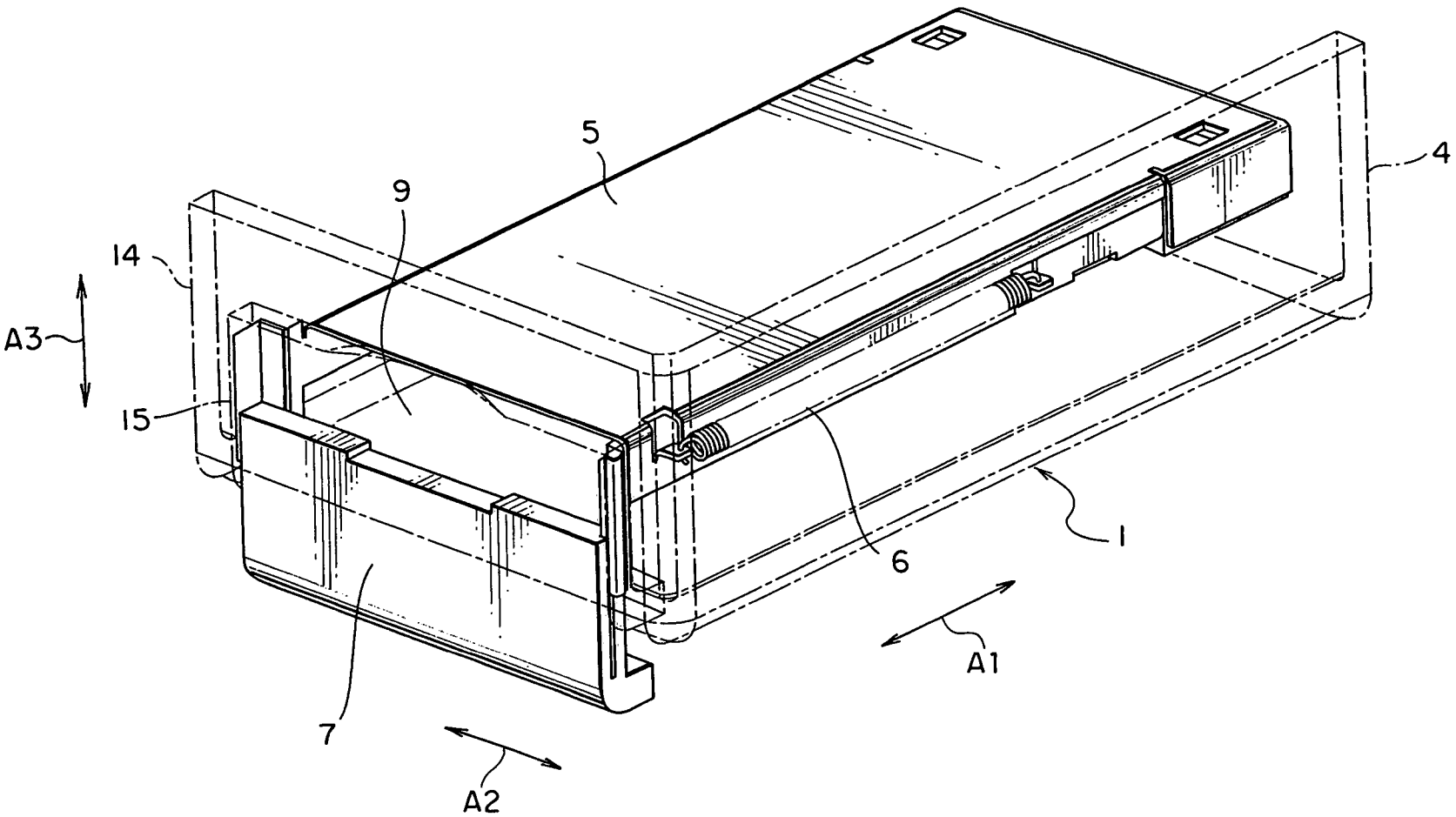
FIG. 13 is a perspective view of the card connector illustrated in FIG. 12 when the card insertion slot is opened by the tab of the card connector.

Referring to FIGS. 12 and 13, a card connector according to a fifth embodiment of the present invention will be described. Similar parts are designated by like reference and will not be described.

In the card connector 1 illustrated in FIGS. 12 and 13, the tab 7 is received in a receiving portion 15 formed at a front portion 14 of the card guide 4 to be slidable up and down in a vertical direction. When the tab 7 in the state illustrated in FIG. 12 is slid downward, the card insertion slot 9 is opened as illustrated in FIG. 13.

Figure 14:
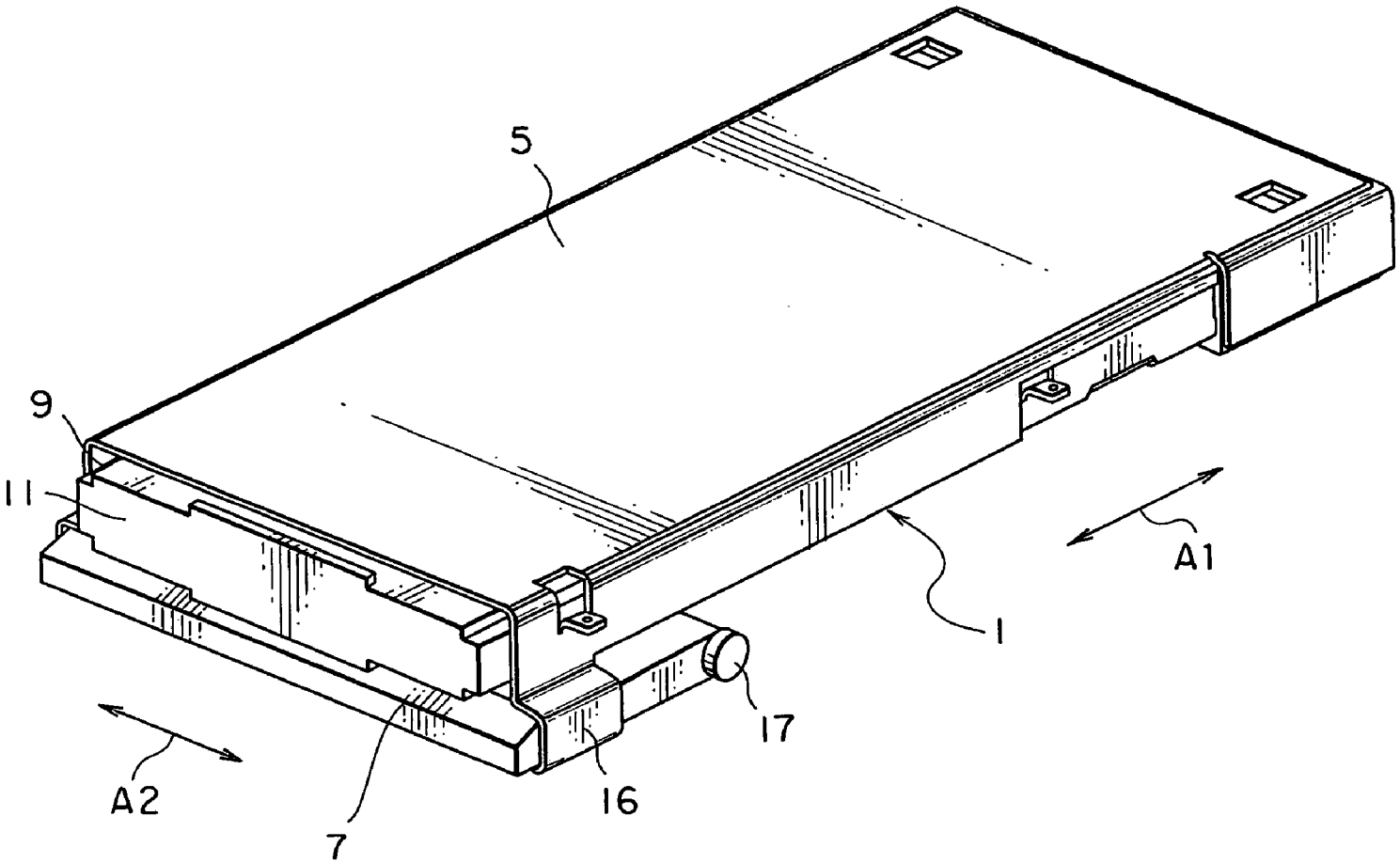
FIG. 14 is a perspective view of a card connector according to a sixth embodiment of the present invention when a tab of the card connector is placed at a retracted position.
Figure 15:
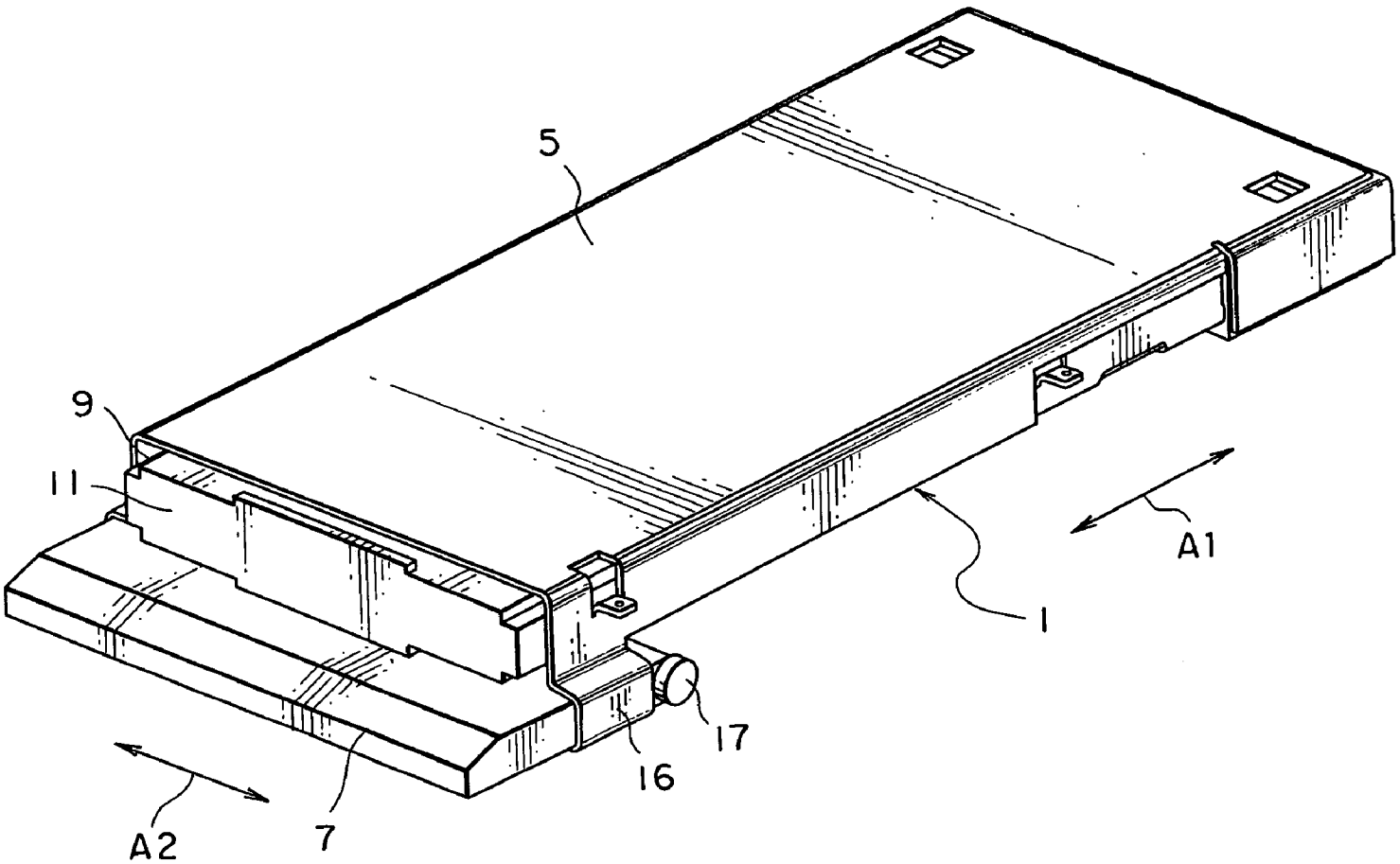
FIG. 15 is a perspective view of the card connector illustrated in FIG. 14 when the tab of the card connector is pulled out from the retracted position.

Referring to FIGS. 14 and 15, a card connector according to a sixth embodiment of the present invention will be described. Similar parts are designated by like reference numerals and will not be described.

In the card connector 1 illustrated in FIGS. 14 and 15, the tab 7 is supported by a pair of tab supporting portions 16 having a generally U-shaped section and formed on opposite sides of the slider 5 to be slidable forward and backward in the first direction A1. When the tab 7 in the state illustrated in FIG. 14 is slid forward, the tab 7 is protruded as illustrated in FIG. 15. When the tab 7 is further moved forward, the tab supporting portions 16 are pushed forward by a pair of protruding portions 17 formed on left and right sides of an inner end of the tab 7. As a consequence, the slider 5 is pulled out.

While this invention has thus far been described in conjunction with the preferred embodiments thereof, it will be readily possible for those skilled in the art to put this invention into practice in various other manners.

What is claimed is:

1. A card connector for use in connecting a card, said card connector comprising:

a card guide for defining a fitting position and a releasing position of said card in a first direction and for guiding movement of said card;

a slider coupled to said card guide to be slidable in said first direction; and an elastic member continuously urging said slider towards said fitting position, said slider having a butting portion to be engaged with said card at said fitting position to transfer said card to said releasing position when said slider is slid against urging force of said elastic member.

2. The card connector according to claim 1, further comprising a temporality holding portion for temporarily holding said card at said releasing position when said slider is returned to its initial position under the urging force of said elastic member.

3. The card connector according to claim 1, further comprising a tab movably held by said slider.

4. The card connector according to claim 3, wherein said card guide has a card insertion slot, said tab being adapted to open and close said card insertion slot.

5. The card connector according to claim 3, wherein said tab is rotatable with respect to said slider.

6. The card connector according to claim 3, wherein said tab is slidable with respect to said slider.

7. The card connector according to claim 1, wherein said card guide has a channel member extending in said first direction, said slider having a channel member fitting over the outside of said card guide to be slidable.

8. The card connector according to claim 1, wherein said card guide comprises:

a main plate portion extending long in said first direction;

a pair of side plate portions bent from opposite sides of said main plate portion of said card guide and faced to each other; and a pair of guide portions bent inward from lower ends of said side plate portions, respectively, said main plate portion and said guide portions cooperatively defining said fitting position and said releasing position.

9. The card connector according to claim 8, wherein said slider comprises a main plate portion extending long in said first direction and a pair of side plate portions bent from opposite long sides of said main plate portion of said slider and faced to each other, said slider fitting over the outside of said card guide, said main plate portion of said slider being faced to said main plate portion of said card guide, said side plate portions of said slider being faced to said side plate portions of said card guide, respectively.

10. The card connector according to claim 9, wherein said main plate portion of said card guide has a window extending in said first direction, said butting portion protruding through said window to the inside of said card guide.

* * * * *